US007183727B2

(12) United States Patent
Ferguson et al.

(10) Patent No.: US 7,183,727 B2
(45) Date of Patent: Feb. 27, 2007

(54) OPTICAL AND TEMPERATURE FEEDBACKS TO CONTROL DISPLAY BRIGHTNESS

(75) Inventors: Bruce R. Ferguson, Anaheim, CA (US); George C. Henry, Simi Valley, CA (US); Roger Holliday, Santa Ana, CA (US)

(73) Assignee: Microsemi Corporation, Irvine, CA (US)

( * ) Notice: Subject to any disclaimer, the term of this patent is extended or adjusted under 35 U.S.C. 154(b) by 245 days.

(21) Appl. No.: 10/937,889

(22) Filed: Sep. 9, 2004

(65) Prior Publication Data

US 2005/0088102 A1 Apr. 28, 2005

Related U.S. Application Data

(60) Provisional application No. 60/505,074, filed on Sep. 23, 2003.

(51) Int. Cl.
*H05B 37/02* (2006.01)
*G09G 3/36* (2006.01)

(52) U.S. Cl. ..... 315/308; 315/149; 315/309; 345/102

(58) Field of Classification Search ..... 315/149, 315/150, 156, 158, 291, 307, 308, 309; 345/102
See application file for complete search history.

(56) References Cited

U.S. PATENT DOCUMENTS

| | | | | |
|---|---|---|---|---|
| 3,449,629 | A * | 6/1969 | Wigert et al. | 315/151 |
| 5,089,748 | A | 2/1992 | Ihms | 315/151 |
| 5,440,208 | A | 8/1995 | Uskaly et al. | 315/169.3 |
| 5,493,183 | A | 2/1996 | Kimball | 315/308 |
| 5,754,013 | A | 5/1998 | Praiswater | 315/307 |
| 5,760,760 | A | 6/1998 | Helms | 345/102 |
| 5,786,801 | A * | 7/1998 | Ichise | 345/102 |
| 6,069,448 | A | 5/2000 | Yeh | 315/149 |
| 6,157,143 | A * | 12/2000 | Bigio et al. | 315/307 |
| 6,198,234 | B1 * | 3/2001 | Henry | 315/291 |
| 6,252,355 | B1 | 6/2001 | Meldrum et al. | 315/150 |
| 6,255,784 | B1 | 7/2001 | Weindorf | 315/291 |
| 6,313,586 | B1 * | 11/2001 | Yamamoto et al. | 315/224 |
| 6,388,388 | B1 | 5/2002 | Weindorf et al. | 315/169.3 |
| 6,396,217 | B1 | 5/2002 | Weindorf | 315/169.1 |
| 6,424,100 | B1 | 7/2002 | Kominami et al. | 315/307 |
| 6,479,810 | B1 | 11/2002 | Weindorf | 250/214 AL |
| 6,483,245 | B1 | 11/2002 | Weindorf | 315/82 |
| 6,507,286 | B2 | 1/2003 | Weindorf et al. | 340/815.75 |
| 6,521,879 | B1 | 2/2003 | Rand et al. | 250/205 |
| 6,563,479 | B2 | 5/2003 | Weindorf et al. | 345/77 |

(Continued)

OTHER PUBLICATIONS

Nguyen, Don J., "Optimizing Mobile Power Delivery". Presented at Intel Developers Forum, Fall 2001, p. 4.
Tannas, Lawrence, "Flat Panel Displays and CRTs". © 1985 Van Nostrand Reinhold Company Inc., pp. 96-99.

*Primary Examiner*—Thuy Vinh Tran
(74) *Attorney, Agent, or Firm*—Knobbe, Martens, Olson & Bear LLP

(57) ABSTRACT

An illumination control circuit allows a user to set a desired brightness level and maintains the desired brightness level over temperature and life of a light source. The illumination control circuit uses a dual feedback loop with both optical and thermal feedbacks. The optical feedback loop controls power to the light source during normal operations. The thermal feedback loop overrides the optical feedback loop when the temperature of the light source becomes excessive.

20 Claims, 13 Drawing Sheets

U.S. PATENT DOCUMENTS

| | | | | |
|---|---|---|---|---|
| 6,642,674 | B2 | 11/2003 | Liao et al. | 315/291 |
| 6,664,744 | B2 | 12/2003 | Dietz | 315/291 |
| 6,703,998 | B1 | 3/2004 | Kabel et al. | 345/102 |
| 6,717,375 | B2 | 4/2004 | Noguchi et al. | 315/291 |
| 6,816,142 | B2 * | 11/2004 | Oda et al. | 345/89 |
| 2002/0118182 | A1 | 8/2002 | Weindorf | 345/204 |
| 2002/0130786 | A1 * | 9/2002 | Weindorf | 340/815.45 |
| 2003/0025462 | A1 | 2/2003 | Weindorf | 429/19 |
| 2003/0227435 | A1 | 12/2003 | Hsieh | 345/102 |
| 2004/0012556 | A1 | 1/2004 | Yong et al. | 345/102 |
| 2004/0145558 | A1 | 7/2004 | Cheng | 345/102 |

* cited by examiner

OPTICAL AND TEMPERATURE FEEDBACKS TO CONTROL DISPLAY BRIGHTNESS

CLAIM FOR PRIORITY

This application claims the benefit of priority under 35 U.S.C. § 119(e) of U.S. Provisional Application No. 60/505,074 entitled "Thermal and Optical Feedback Circuit Techniques for Illumination Control," filed on Sep. 23, 2003, the entirety of which is incorporated herein by reference.

BACKGROUND OF THE INVENTION

1. Field of the Invention

The present invention relates to a backlight system, and more particularly relates to using optical and temperature feedbacks to control the brightness of the backlight.

2. Description of the Related Art

Backlight is used in liquid crystal display (LCD) applications to illuminate a screen to make a visible display. The applications include integrated displays and projection type systems, such as a LCD television, a desktop monitor, etc. The backlight can be provided by a light source, such as, for example, a cold cathode fluorescent lamp (CCFL), a hot cathode fluorescent lamp (HCFL), a Zenon lamp, a metal halide lamp, a light emitting diode (LED), and the like. The performance of the light source (e.g., the light output) is sensitive to ambient and lamp temperatures. Furthermore, the characteristics of the light source change with age.

SUMMARY OF THE INVENTION

One embodiment of the present invention is an illumination control circuit which allows a user to set a desired brightness level and maintains the desired brightness level over temperature and life of a light source (e.g., a fluorescent lamp). The illumination control circuit uses an optical sensor (e.g., a visible light sensor) to maintain consistent brightness over lamp life and over extreme temperature conditions. The illumination control circuit further includes a temperature sensor to monitor lamp temperature and prolongs lamp life by reducing power to the fluorescent lamp when the lamp temperature is excessive. In one embodiment, the illumination control circuit optionally monitors ambient light and automatically adjusts lamp power in response to variations for optimal power efficiency.

The brightness (or the light intensity) of the light source (e.g., CCFL) is controlled by controlling a current (i.e., a lamp current) through the CCFL. For example, the brightness of the CCFL is related to an average current provided to the CCFL. Thus, the brightness of the CCFL can be controlled by changing the amplitude of the lamp current (e.g., amplitude modulation) or by changing the duty cycle of the lamp current (e.g., pulse width modulation).

A power conversion circuit (e.g., an inverter) is generally used for driving the CCFL. In one embodiment, the power conversion circuit includes two control loops (e.g., an optical feedback loop and a thermal feedback loop) to control the lamp current. A first control loop senses the visible light produced by the CCFL, compares the detected visible light to a user defined brightness setting, and generates a first brightness control signal during normal lamp operations. A second feedback loop senses the temperature of the CCFL, compares the detected lamp temperature to a predefined temperature limit, and generates a second brightness control signal that overrides the first brightness control signal to reduce the lamp current when the detected lamp temperature is greater than the predefined temperature limit. In one embodiment, both of the control loops use error amplifiers to perform the comparisons between detected levels and respective predetermined levels. The outputs of the error amplifiers are wired-OR to generate a final brightness control signal for the power conversion circuit.

In one embodiment, an illumination control circuit includes an optical or a thermal feedback sensor integrated with control circuitry to provide adjustment capabilities to compensate for temperature variations, to disguise aging, and to improve the response speed of the light source. For example, LCD computer monitors make extensive use of sleep functions for power management. The LCD computer monitors exhibit particular thermal characteristics depending on the sleep mode patterns. The thermal characteristics affect the "turn on" brightness levels of the display. In one embodiment, the illumination control circuit operates in a boost mode to expedite the display to return to a nominal brightness after sleep mode or an extended off period.

In one embodiment, a light sensor (e.g., an LX1970 light sensor from Microsemi Corporation) is coupled to a monitor to sense the perceived brightness of a CCFL used in the backlight or display. For example, the light sensor can be placed in a hole in the back of the display. The light sensor advantageously has immunity to infrared light and can accurately measure perceived brightness when the CCFL is in a warming mode. The output frequency of the CCFL shifts from infrared to the visible light spectrum as the temperature increases during the warming mode.

In one embodiment, the output of the light sensor is used by a boost function controller to temporary increase lamp current to the CCFL to reach a desired brightness level more quickly than using standard nominal lamp current levels. The light sensor monitors the CCFL light output and provides a closed loop feedback method to determine when a boost in the lamp current is desired. In an alternate embodiment, a thermistor is used to monitor the temperature of the CCFL lamp and to determine when boosted lamp current is desired.

In one embodiment, an inverter is used to drive the CCFL. The inverter includes different electrical components, and one of the components with a temperature profile closely matching the temperature profile of the CCFL is used to track the warming and cooling of a LCD display. The component can be used as a reference point for boost control functions when direct access to lamp temperature is difficult.

Providing a boost current to the CCFL during initial activation or reactivation from sleep mode of the display improves the response time of the display. For example, the display brightness may be in the range of 40%–50% of the nominal range immediately after turn on. Using a normal start up current (e.g., 8 mA) at 23 degrees C., the 90% brightness level may be achieved in 26 minutes. Using a 50% boost current (e.g., 12 mA), the 90% brightness level may be achieved in 19 seconds. The boost level can be adjusted as desired to vary the warm-up time of the display. The warm-up time is a function of the display or monitor settling temperature. For example, shorter sleep mode periods mean less warm-up times to reach the 90% brightness level.

In one embodiment, the boost control function can be implemented with low cost and low component count external circuitry. The boost control function enhances the performance of the display monitor for a computer user. For example, the display monitor is improved by reducing the time to reach 90% brightness by 50 to 100 times. The boost control function benefits office or home computing environments where sleep mode status is frequent. Furthermore, as the size of LCD display panels increase in large screen displays, the lamp length and chassis also increase. The larger lamp and chassis leads to system thermal inertia, which slows the warm-up time. The boost control function can be used to speed up the warm-up time.

In one embodiment, a light sensor monitors an output of a CCFL. A boost control circuit compares an output of the light sensor to a desired level. When the output of the light sensor is less than the desired level, the CCFL is operated at a boost mode (e.g., at an increased or boosted lamp current level). As the output of the light sensor reaches the desired level, indicating that the brightness is approaching a desired level, the boosted lamp current is reduced to a preset nominal current level.

In one embodiment, the boost control circuit is part of the optical feedback loop and facilitates a display that is capable of compensating for light output degradation over time. For example, as the lamp output degrades over usage hours, the lamp current level can be increased to provide a consistent light output. LCD televisions and automotive GPS/Telematic displays can offer substantially the same brightness provided on the day of purchase after two years of use.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage of group of advantages as taught herein without necessarily achieving other advantages as may be taught or suggested herein.

DETAILED DESCRIPTION OF THE INVENTION

Figure 1:
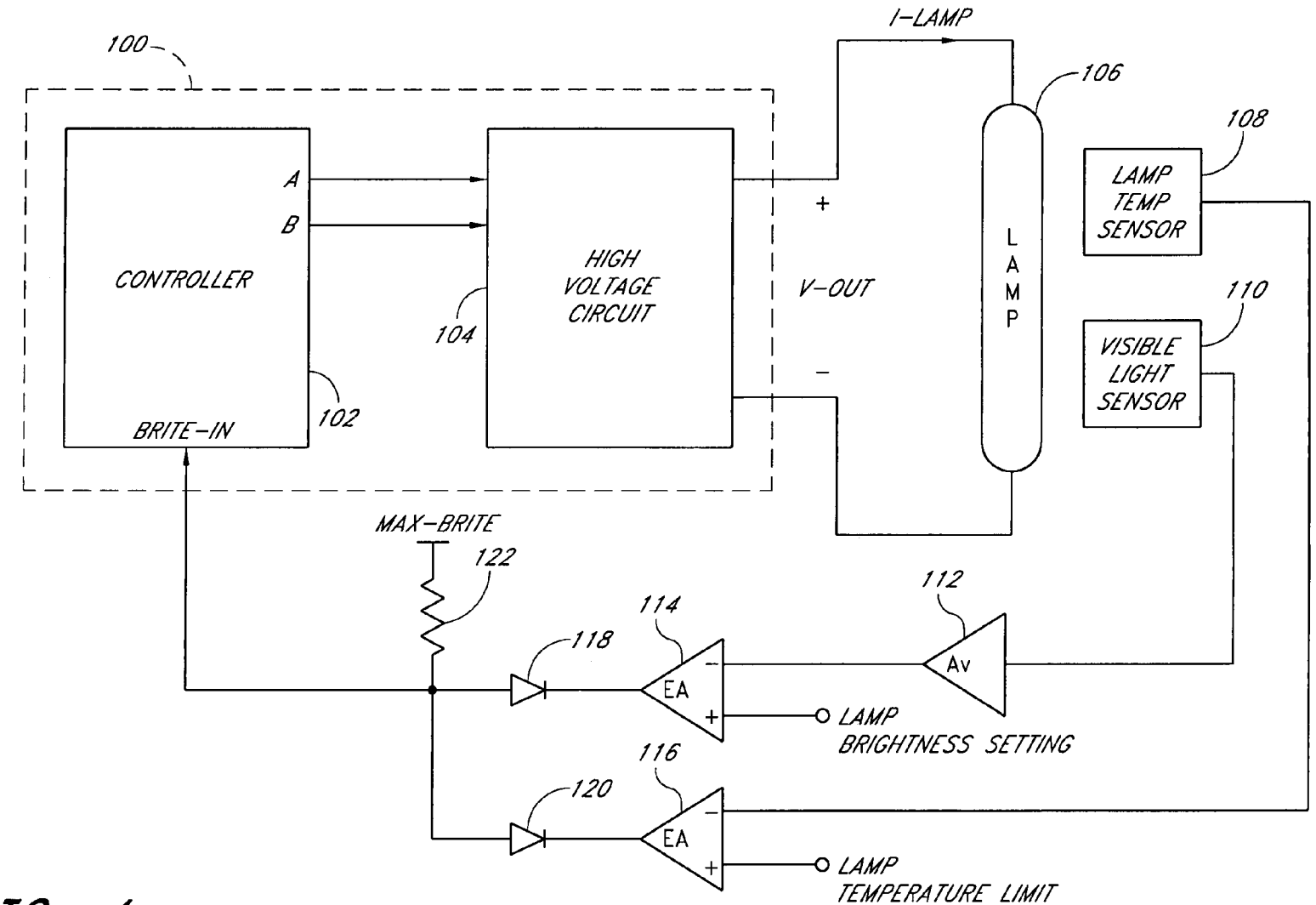
FIG. 1 is a block diagram of a power conversion circuit with dual feedback loops in accordance with one embodiment of the invention.

Various embodiments of the present invention will be described hereinafter with reference to the drawings. FIG. 1 is a block diagram of a power conversion circuit (or backlight system) with dual feedback loops in accordance with one embodiment of the invention. The backlight system may be advantageously used in automotive applications which are exposed to relatively extreme temperature variations and suffer brightness loss at low ambient temperatures. The backlight system can also be used in other LCD applications, such as computer notebooks, computer monitors, handheld devices, television displays, and the like. The dual feedback loops allow a user to set a desired brightness level for a backlight light source and maintain the desired brightness level over operating temperature and over degradation of the light source efficacy over life. The dual feedback loops also extend the useful life of the light source by maintaining safe operating conditions for the light source.

The power conversion circuit of FIG. 1 generates a substantially alternating current (AC) output voltage (V-OUT) to drive a fluorescent lamp (e.g., a CCFL) 106. In one embodiment, an inverter 100 generates the substantially AC output voltage from a direct current (DC) input voltage. The inverter 100 includes a controller 102 which accepts a brightness control input signal (BRITE-IN) and generates switching signals (A, B) to a high voltage circuit 104 to generate the substantially AC output voltage. A corresponding AC lamp current (I-LAMP) flows through the CCFL 106 to provide illumination.

Figure 2:
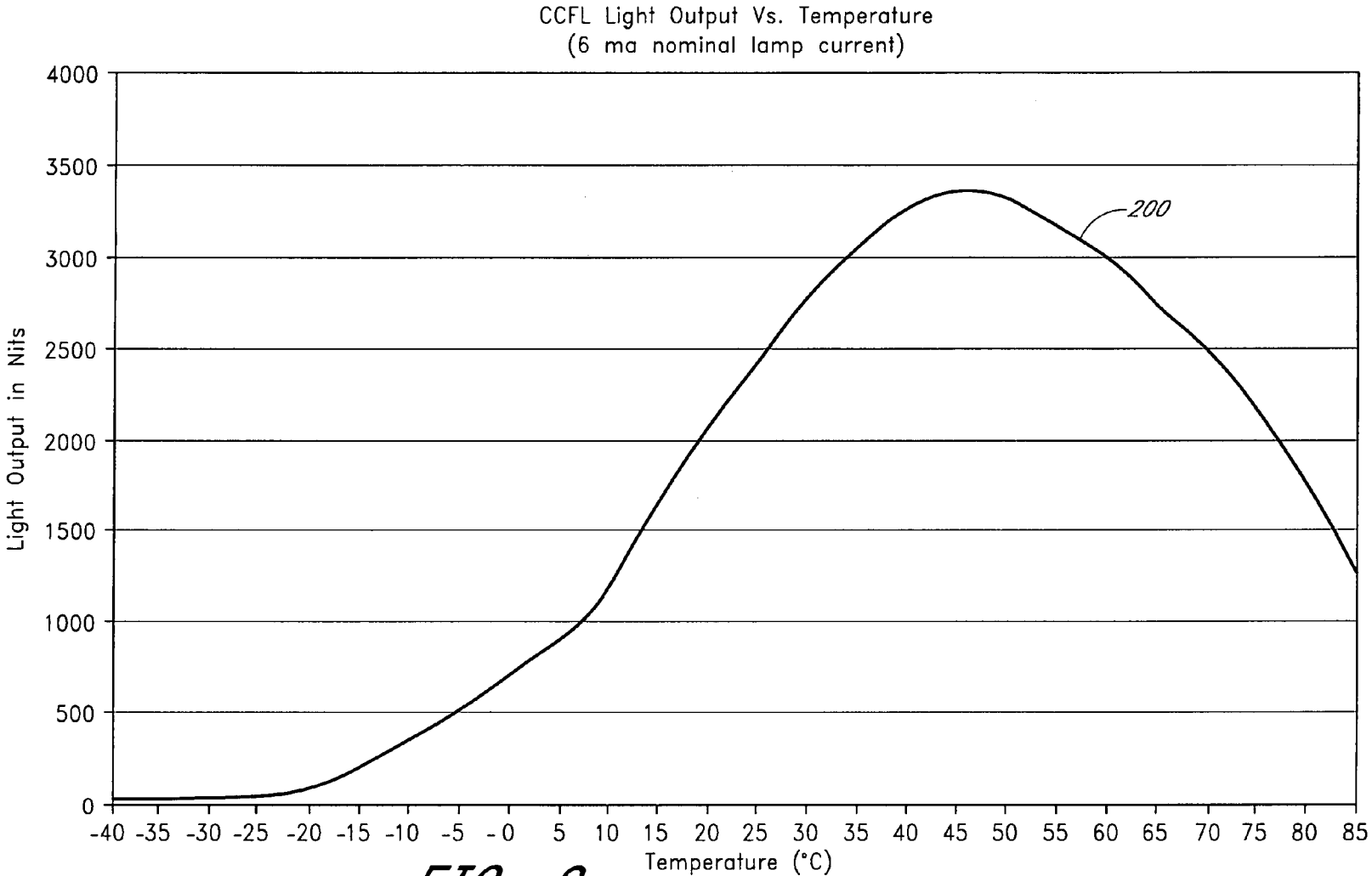
FIG. 2 illustrates light output of a CCFL with respect to temperature.

In one embodiment, the dual feedback loops control the brightness of the CCFL 106 and include an optical feedback loop and a lamp temperature feedback loop. The dual feedback loops generate the brightness control input signal to the controller 102. The brightness of the CCFL 106 is a function of the root mean square (RMS) level of the lamp current, ambient temperature of the CCFL 106, and life of the CCFL 106. For example, FIG. 2 illustrates light output of a CCFL with respect to temperature. The lamp brightness is affected by ambient and lamp temperatures. A graph 200 shows the relationship for a standard pressure CCFL at a nominal operating lamp current of 6 mA.

Lamp brightness decreases as the CCFL 106 ages (or when the lamp temperature decreases) even though the RMS level of the lamp current remains the same. The dual feedback loops facilitate consistent lamp brightness over lamp life and varying lamp temperature by compensating with adjusted RMS levels of the lamp current. The dual feedback loops further facilitate prolonged lamp life by monitoring the temperature of the CCFL 106.

As shown in FIG. 1, the optical feedback loop includes a visible light sensor 110, an optional gain amplifier 112, and a first error amplifier 114. The visible light sensor 110 monitors the actual (or perceived) brightness of the CCFL 106 and outputs an optical feedback signal indicative of the lamp brightness level. The optional gain amplifier 112 conditions (e.g., amplifies) the optical feedback signal and presents a modified optical feedback signal to the first error amplifier 114. In one embodiment, the modified optical feedback signal is provided to an inverting input of the first error amplifier 114. A first reference signal (LAMP BRIGHTNESS SETTING) indicative of a desired lamp intensity is provided to a non-inverting input of the first error amplifier 114. The first reference signal can be defined (varied or selected) by a user.

The first error amplifier 114 outputs a first brightness control signal used to adjust the lamp drive current to achieve the desired lamp intensity. For example, the lamp current is regulated by the optical feedback loop such that the modified optical feedback signal at the inverting input of the first error amplifier 114 is substantially equal to the first reference signal. The optical feedback loop compensates for aging of the CCFL 106 and lamp temperature variations during normal operations (e.g., when the lamp temperature is relatively cool). For example, the optical feedback loop may increase the lamp drive current as the CCFL 106 ages or when the lamp temperature drops.

There is a possibility that an aged lamp in hot ambient temperature may be driven too hard and damaged due to excessive heat. The lamp temperature feedback loop monitors the lamp temperature and overrides the optical feedback loop when the lamp temperature exceeds a predetermined temperature threshold. In one embodiment, the lamp temperature feedback loop includes a lamp temperature sensor 108 and a second error amplifier 116. The lamp temperature sensor 108 can detect the temperature of the CCFL 106 directly or derive the lamp temperature by measuring ambient temperature, temperature of a LCD bezel, amount of infrared light produced by the CCFL 106, or variations in the operating voltage (or lamp voltage) across the CCFL 106. In one embodiment, select components (e.g., switching transistors or transformers) in the inverter 100 can be monitored to track lamp temperature.

The lamp temperature sensor 108 outputs a temperature feedback signal indicative of the lamp temperature to an inverting input of the second error amplifier 116. A second reference signal (LAMP TEMPERATURE LIMIT) indicative of the predetermined temperature threshold is provided to a non-inverting input of the second error amplifier 116. The second error amplifier 116 outputs a second brightness control signal that overrides the first brightness control signal to reduce the lamp drive current when the lamp temperature exceeds the predetermined temperature threshold. Reducing the lamp drive current helps reduce the lamp temperature, thereby extending the life of the CCFL 106.

In one embodiment, the output of the first error amplifier 114 and the output of the second error amplifier 116 are wire-ORed (or coupled to ORing diodes) to generate the brightness control input signal to the controller 102. For example, a first diode 118 is coupled between the output of the first error amplifier 114 and the controller 102. A second diode 120 is coupled between the output of the second error amplifier 116 and the controller 102. The first diode 118 and the second diode 120 have commonly connected anodes coupled to the brightness control input of the controller 102. The cathode of the first diode 118 is coupled to the output of the first error amplifier 114, and the cathode of the second diode 120 is coupled to the output of the second error amplifier 116. Other configurations or components are possible to implement an equivalent ORing circuit to accomplish the same function.

In the above configuration, the error amplifier with a relatively lower output voltage dominates and determines whether the optical feedback loop or the lamp temperature feedback loop becomes the controlling loop. For example, the second error amplifier 116 have a substantially higher output voltage during normal operations when the lamp temperature is less than the predetermined temperature threshold and is effectively isolated from the brightness control input by the second diode 120. The optical feedback loop controls the brightness control input during normal operations and automatically adjusts the lamp drive current to compensate for aging and temperature variations of the CCFL 106. Control of the brightness control input transfers to the lamp temperature feedback loop when the temperature of the CCFL 106 becomes too high. The temperature of the CCFL 106 may be excessive due to relatively high external ambient temperature, relatively high lamp drive current, or a combination of both. The lamp temperature feedback loop reduces (or limits) the lamp drive current to maintain the lamp temperature at or below a predetermined threshold. In one embodiment, the first and second error amplifiers 114, 116 have integrating functions to provide stability to the respective feedback loops.

In one embodiment, the brightness control input signal is a substantially DC control voltage that sets the lamp current. For example, the RMS level of the lamp current may vary with the level of the control voltage. A pull-up resistor 122 is coupled between the brightness control input of the controller 102 and a pull-up control voltage (MAX-BRITE) corresponding to a maximum allowable lamp current. The pull-up control voltage dominates when both of the outputs of the respective error amplifiers 114, 116 are relatively high. The output of the first error amplifier 114 may be relatively high during warm-up or when the CCFL 106 becomes too old to produce the desired light intensity. The output of the second error amplifier 116 may be relatively high when the temperature of the CCFL 106 is relatively cold.

Figure 3:
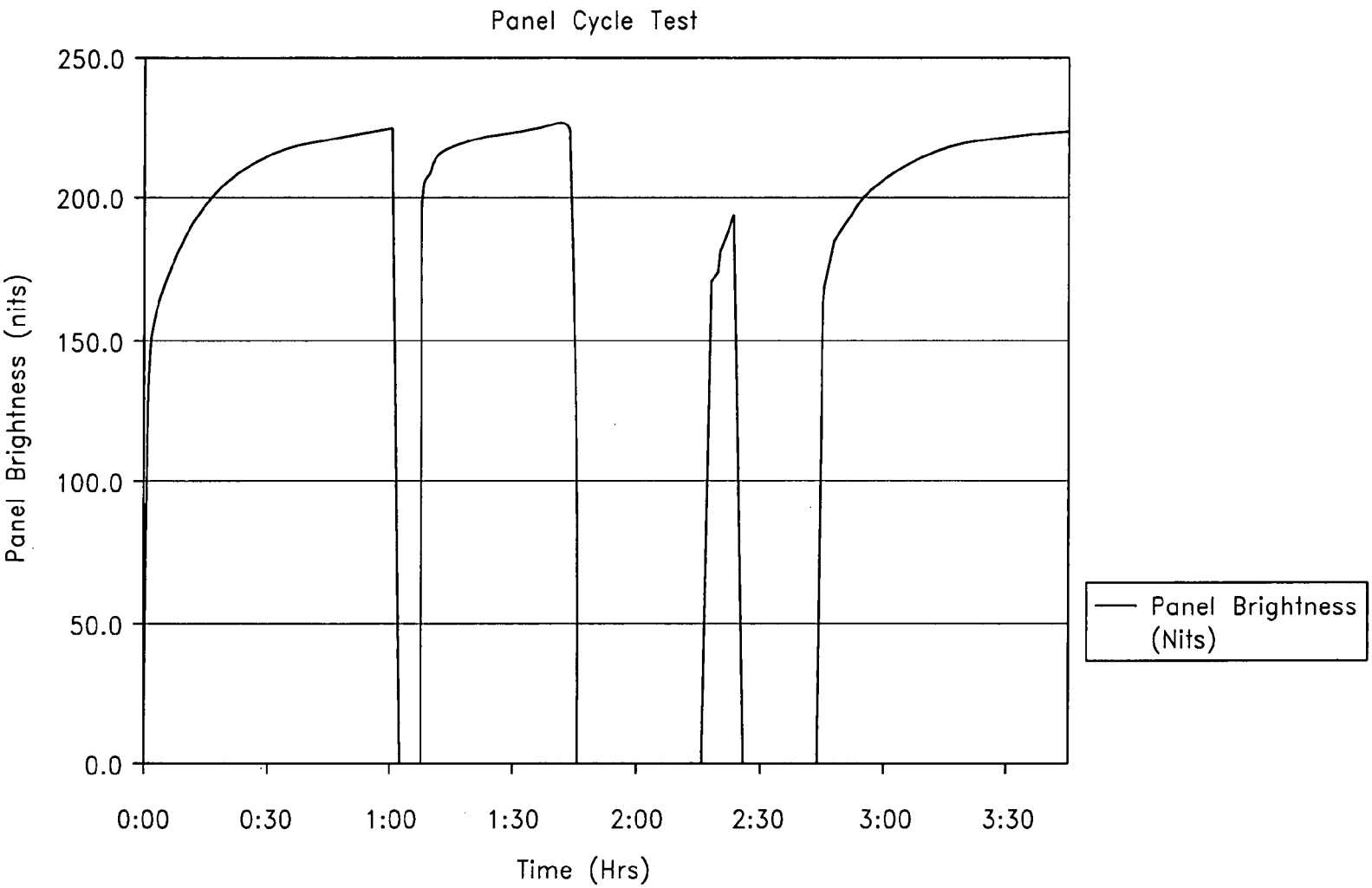
FIG. 3 illustrates panel brightness with respect to time as a display panel cycles on and off.

FIG. 3 illustrates panel brightness with respect to time as a display panel cycles on and off or exits from sleep mode. Computer applications make extensive use of sleep functions for power management. A graph 300 shows different warm-up times depending on how much time elapsed since the display panel was turned off or entered the sleep mode and allowed to cool down. For example, initial panel brightness may be only 60–70% of steady-state panel brightness during warm-up after the display panel turns on or exits from sleep mode. The warm-up time takes longer when the display panel has been inactive for a while, in cooler ambient temperatures, or for larger display panels.

In one embodiment, an optical feedback loop or a temperature feedback loop is used to decrease the warm-up time. For example, a controller controlling illumination of the display panel can operate in overdrive or a boost mode to improve response of the display brightness. The boost mode provides a higher lamp drive current than normal operating lamp current to speed up the time to reach sufficient panel brightness (e.g., 90% of steady-state). In one embodiment, the brightness control input signal described above can be used to indicate to the controller when boost mode operation is desired.

Figure 4:
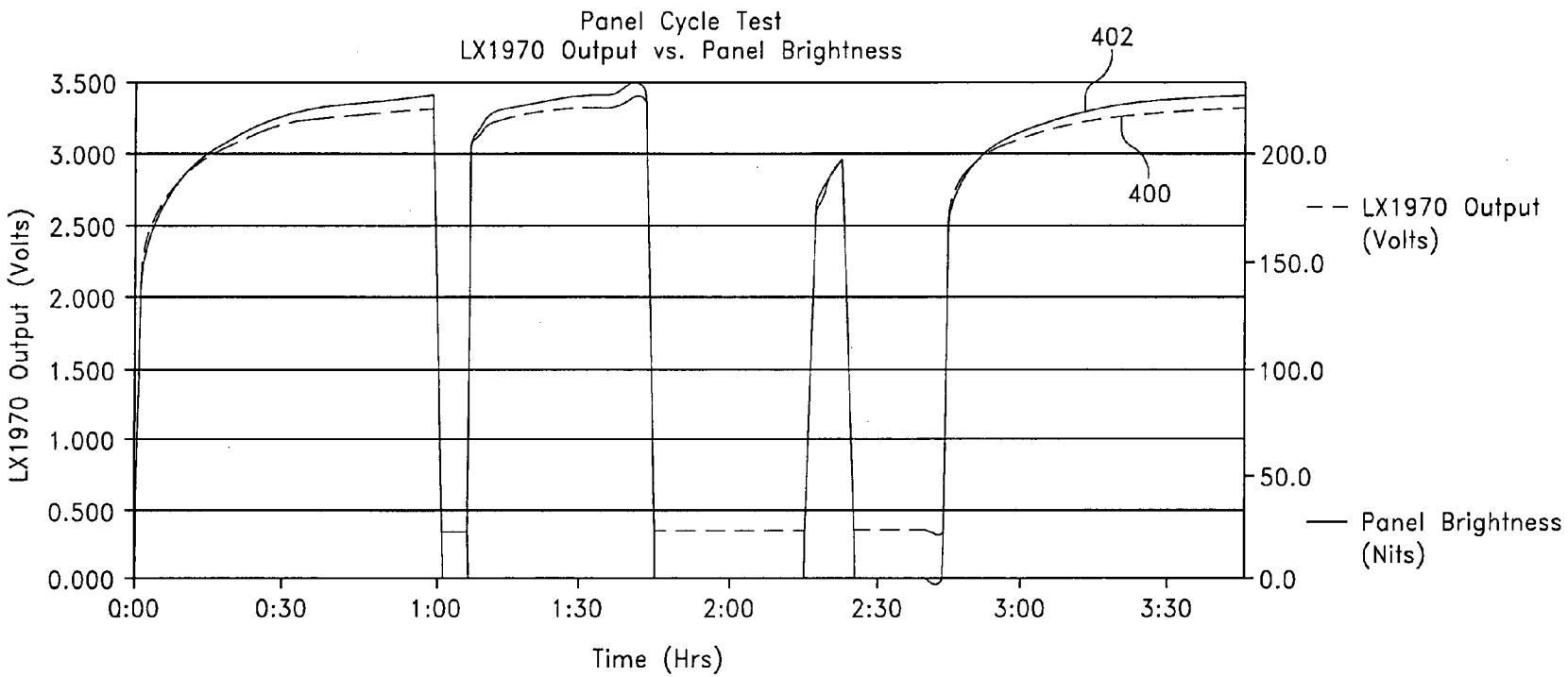
FIG. 4 illustrates waveforms for panel brightness and a light sensor output with respect to time as a display panel cycles on and off.

FIG. 4 illustrates waveforms for panel brightness and a light sensor output with respect to time as a display panel cycles on and off. A graph 402 shows the panel brightness. A graph 400 shows the light sensor output which closely tracks the panel brightness. In one embodiment, the light sensor output is produced by a visible light sensor (e.g., part number LX1970 from Microsemi Corporation).

Figure 5:
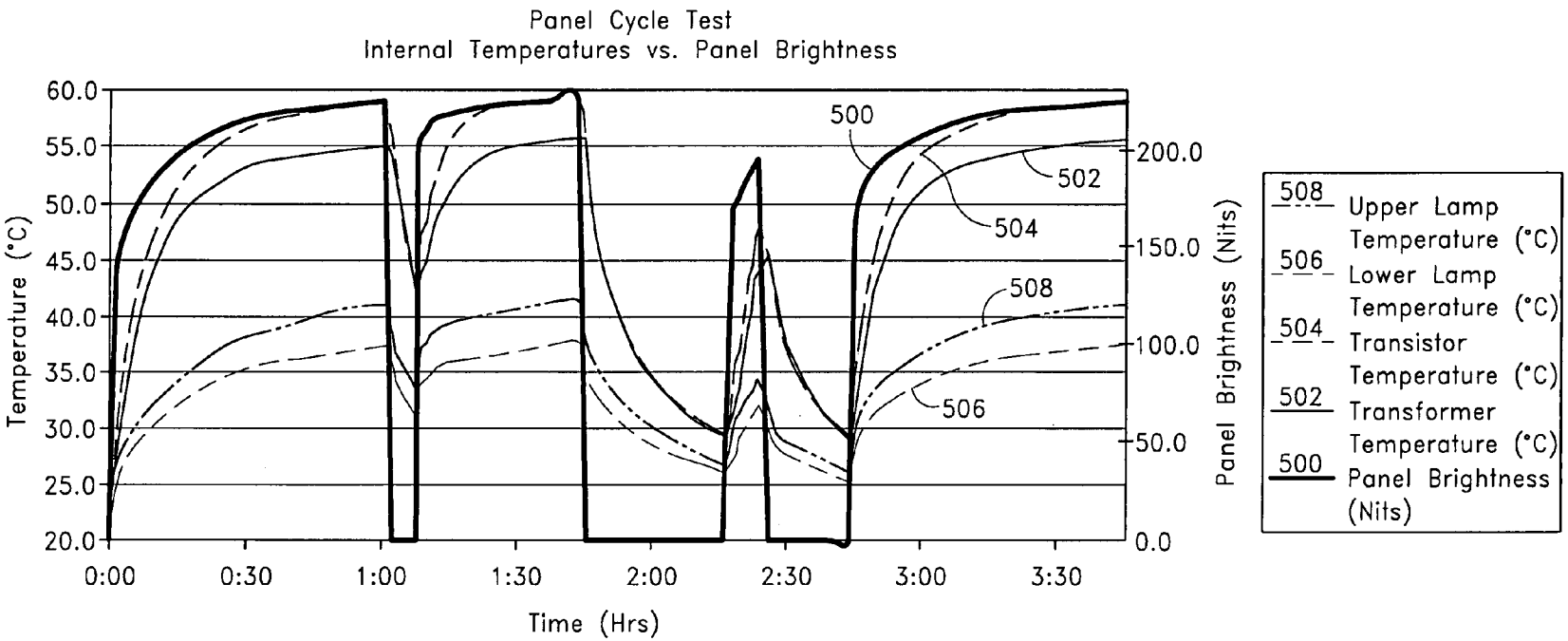
FIG. 5 illustrates waveforms for panel brightness and temperatures of select inverter components with respect to time as a display panel cycles on and off.

FIG. 5 illustrates waveforms for panel brightness and temperatures of select inverter components with respect to time as a display panel cycles on and off. A graph 500 shows the panel brightness. A graph 502 shows the temperature profile of a transformer and a graph 504 shows the temperature profile of a transistor as the panel brightness changes. A graph 506 shows the temperature profile of a lower lamp and a graph 508 shows the temperature profile of an upper lamp as the panel brightness changes. As discussed above, a select component (e.g., the transistor or the transformer) can be used in an indirect method to monitor lamp temperature.

Figure 6:
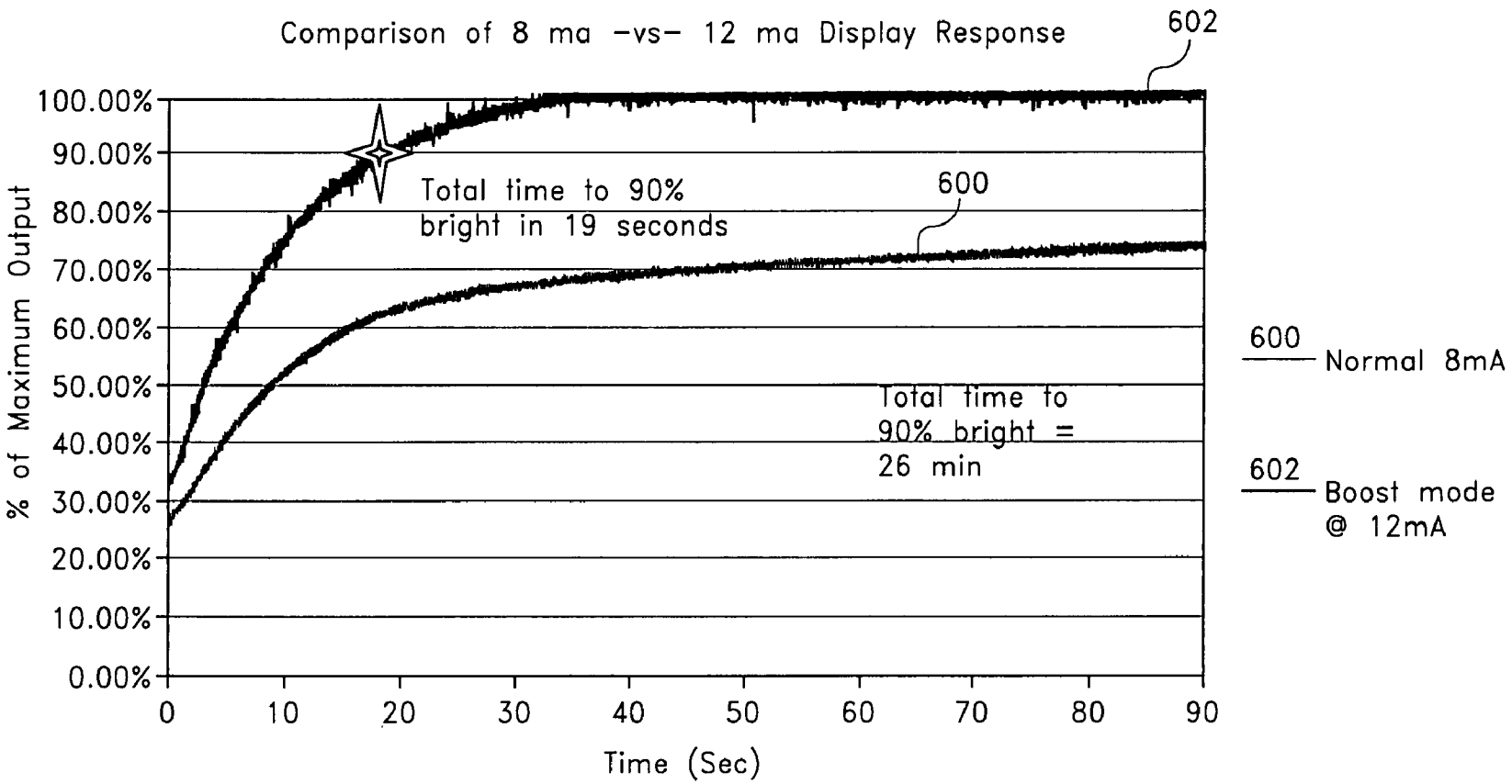
FIG. 6 illustrates waveforms comparing warm-up times using a standard drive current and a boost current.

FIG. 6 illustrates waveforms comparing warm-up times using a standard drive current and a boost current. A graph 600 shows a relatively slow response time for a lamp when a nominal current (e.g., 8 mA) is used to drive the lamp. A graph 602 shows an improved response time for the lamp when a boosted current (e.g., 12 mA) is used to drive the lamp during warm-up.

Figure 7:
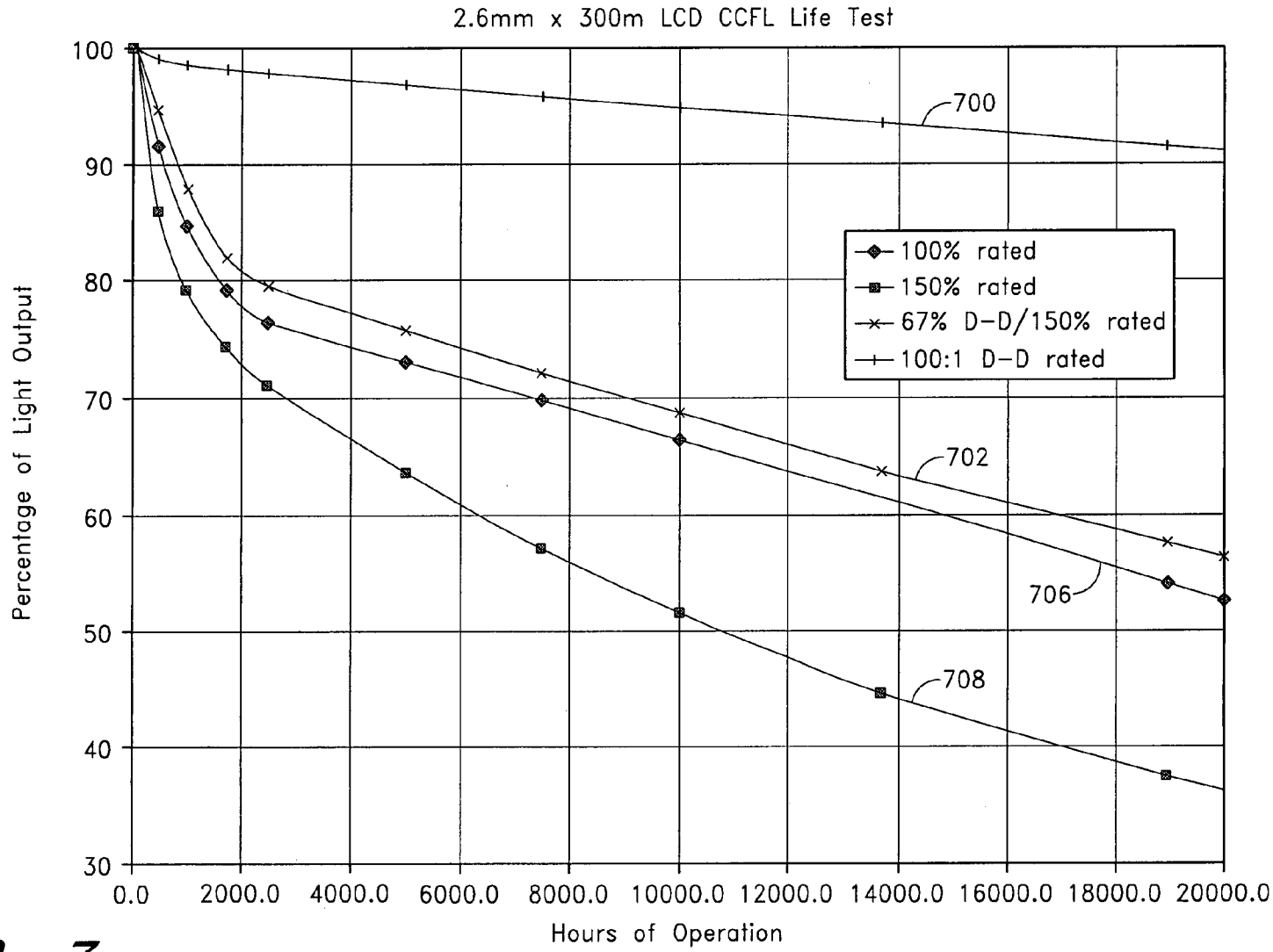
FIG. 7 illustrates waveforms comparing percentage of light output with respect to hours of operation for various operating conditions.

FIG. 7 illustrates waveforms comparing percentage of light output with respect to hours of operation for various operating conditions. A graph 700 shows the light output during life test of a lamp driven by a direct drive inverter running at 1% duty cycle. A graph 702 shows the light output during life test of a lamp driven by the direct drive inverter running at 150% of the rated lamp current or a typical inverter running at 67% of the rated lamp current. A graph 706 shows the light output during life test of a lamp driven by a typical inverter running at 100% of the rated lamp current. Finally, a graph 708 shows the light output during life test of a lamp driven by a typical inverter running at 150% of the rated lamp current. CCFLs degrade at a predictable rate over time. Lamp life specifications are defined as the point at which the display brightness level reduces to 50% of the original level.

Figure 8:
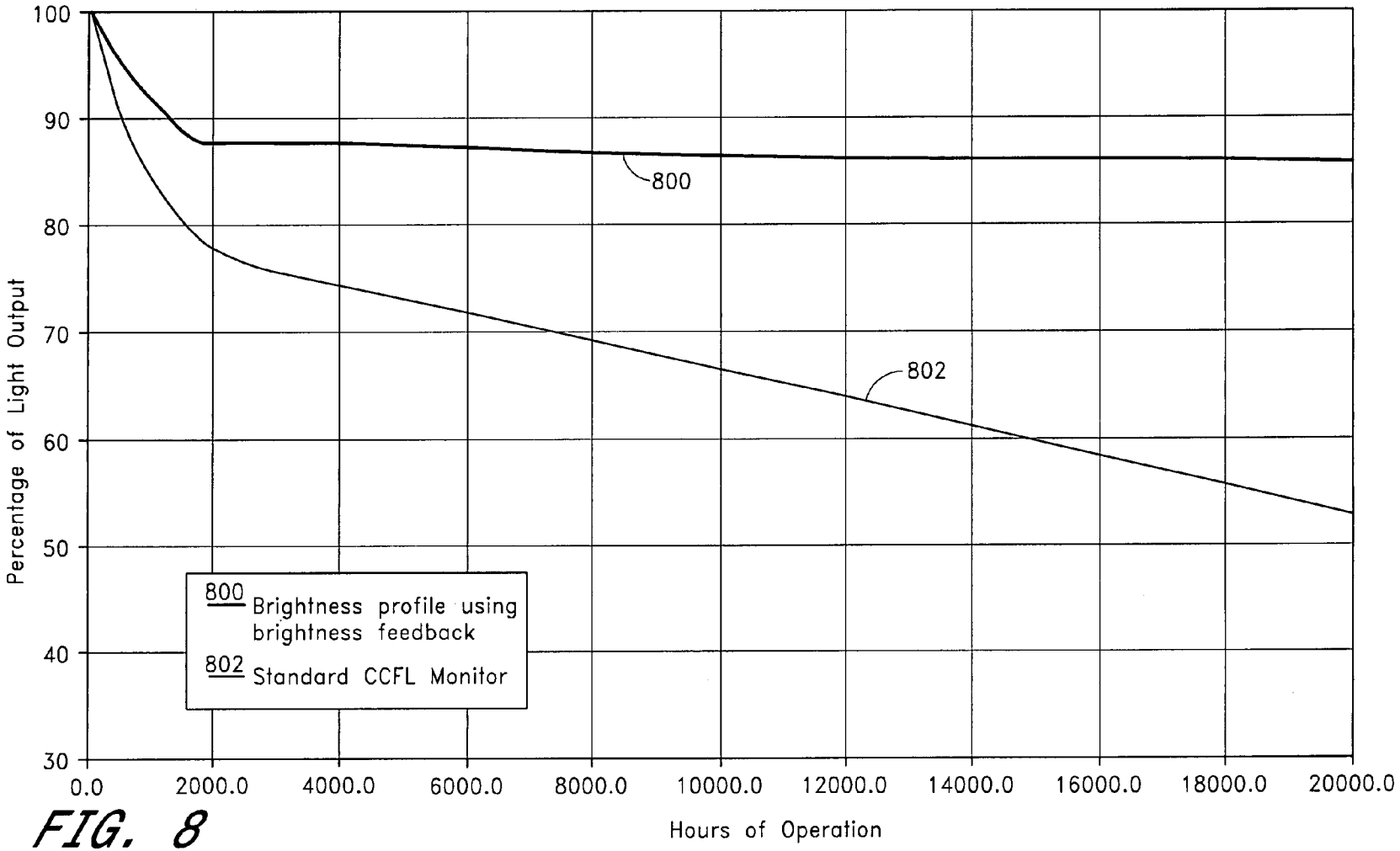
FIG. 8 illustrates waveforms comparing light outputs with and without optical feedback over the life of a CCFL.

FIG. 8 illustrates waveforms comparing light outputs with and without optical feedback over the life of a CCFL. A graph 802 shows the degradation of the light output as the CCFL ages. A graph 800 shows more consistent brightness over the life of the CCFL by using the optical feedback loop described above. Monitoring the perceived brightness of the CCFL provides a low cost and high performance method to maintain "out of the box" brightness levels as the CCFL ages.

Figure 9:
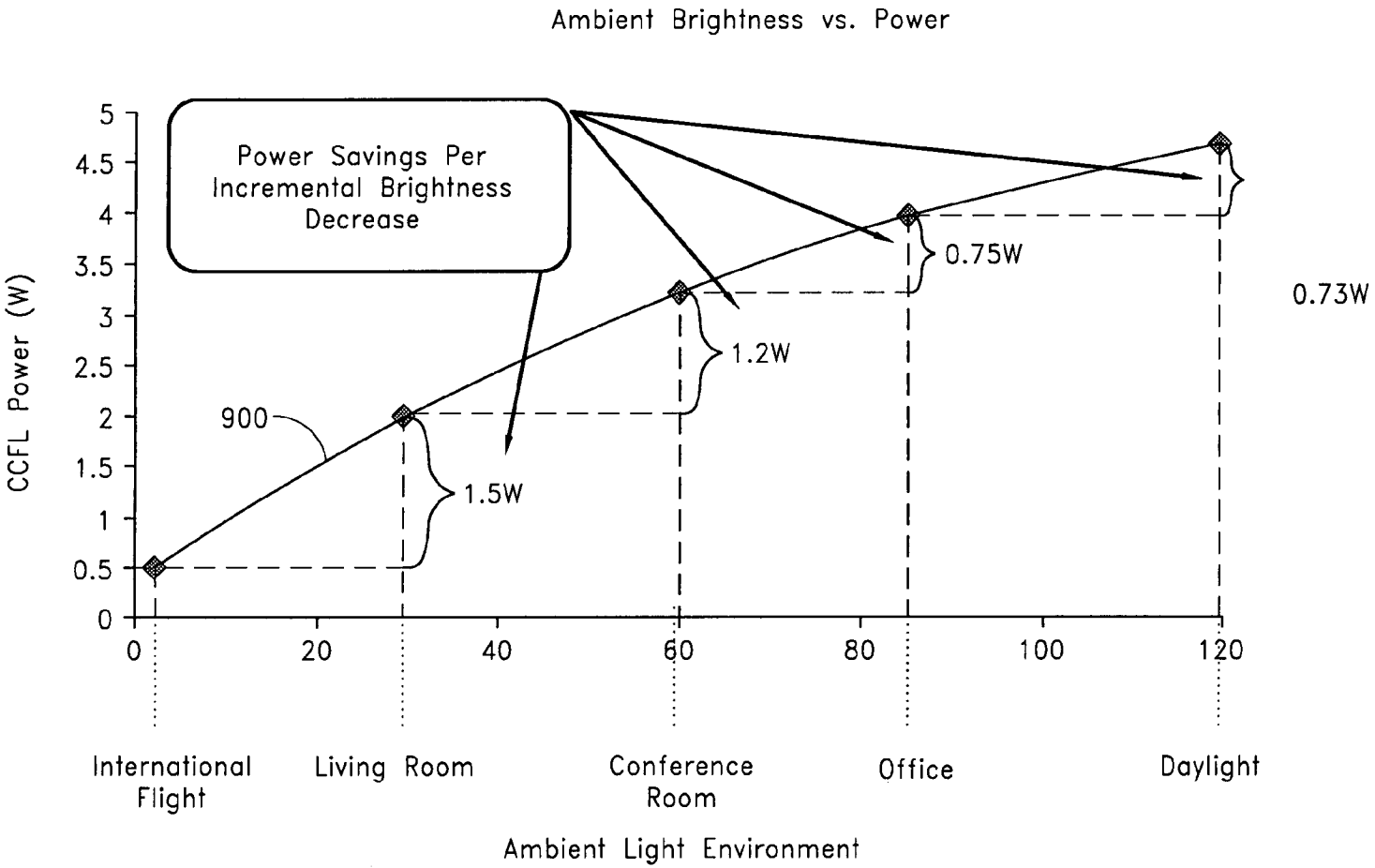
FIG. 9 illustrates power savings associated with decreasing brightness based on ambient light environment.

FIG. 9 illustrates power savings associated with decreasing brightness based on ambient light environment. A graph 900 shows increasing power consumption by a CCFL to produce substantially the same perceived intensity for a display panel as the ambient light increases from a dark environment (e.g., on an airplane) to a bright environment (e.g., daylight). Power can be saved by sensing the ambient (or environment) conditions and adjusting the lamp drive current accordingly. In one embodiment, the optical feedback loop described above can be modified to sense ambient light and make adjustments to lamp current for optimal efficiency. For example, operating lamp current can be decreased/increased when ambient light decreases/increases to save power while achieving substantially the same perceived brightness.

Figure 10A:
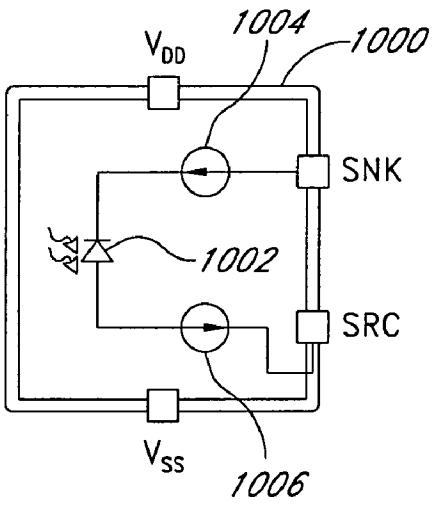
FIGS. 10A and 10B respectively illustrate a block diagram and wavelength sensitivity for one embodiment of a light sensor used to monitor visible light output of a lamp.
Figure 10B:
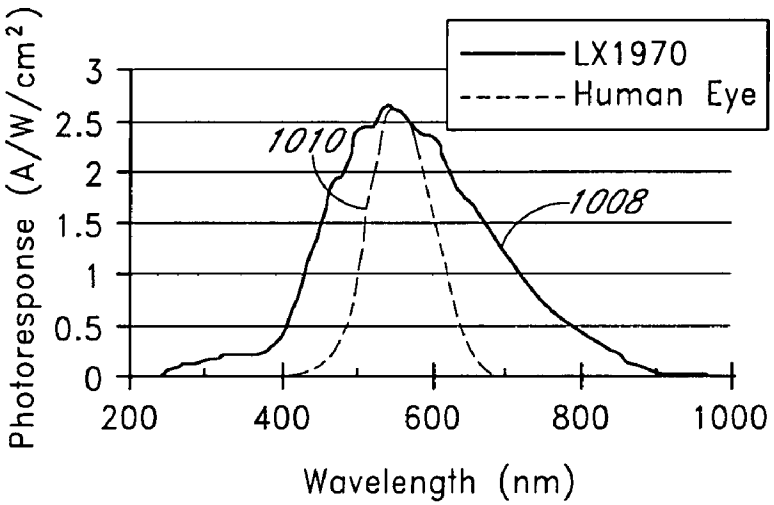

FIGS. 10A and 10B respectively illustrate a block diagram and wavelength sensitivity for one embodiment of a light sensor 1000 used to monitor visible light output of a CCFL or ambient light. CCFLs emit less visible light and more infrared light under relatively cold operating temperatures (e.g., during warm-up). The light sensor 1000 advantageously monitors mostly the visible portion of the light. In one embodiment, the light sensor (e.g., the LX1970 from Microsemi Corporation) 1000 includes a PIN diode array 1002 with an accurate, linear, and very repeatable current transfer function. The light sensor 1000 outputs a current sink 1004 and a current source 1006 with current levels that vary with sensed ambient light. The complementary current outputs of the light sensor 1000 can be easily scaled and converted to a voltage signal by connecting one or more resistors to either or both outputs. Referring to FIG. 10B, a graph 1008 shows the frequency response of the light sensor 1000 which approximates the frequency (or spectral) response of human eyes shown by graph 1010.

Figure 11:
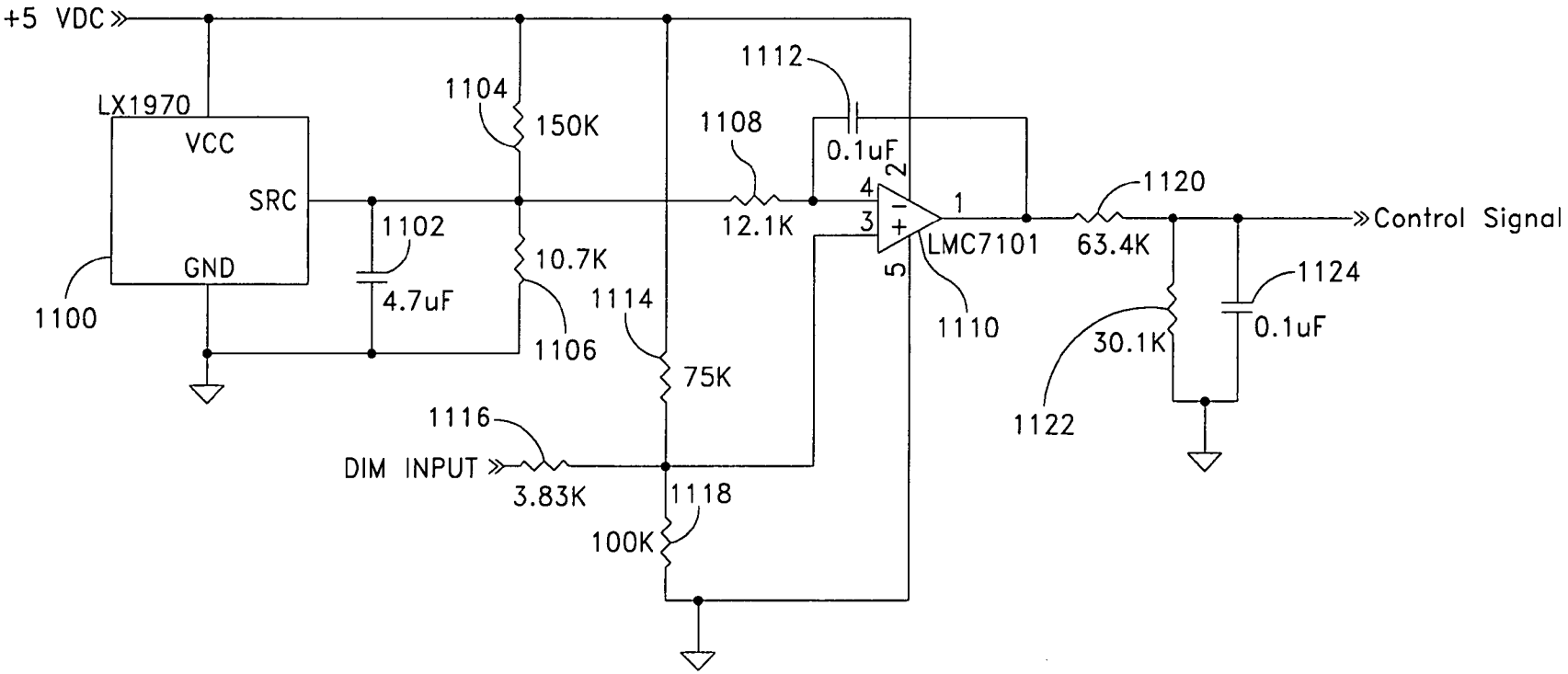
FIG. 11 is a schematic illustration of one embodiment of an automatic brightness control circuit that senses light output of a lamp and adjusts an inverter brightness control signal.

FIG. 11 is a schematic illustration of one embodiment of an automatic brightness control circuit that senses lamp light and generates a control signal for adjusting the operating current of the lamp. For example, the automatic brightness control circuit can vary the control signal until the sensed lamp light corresponds to a desired level indicated by a user input (e.g., DIM INPUT). Alternately, the automatic brightness control circuit can indicate when boost mode operation is desired to improve response speed of the lamp. The automatic brightness control circuit includes a visible light (or photo) sensor 1100 and an error gain amplifier 1110. In one embodiment, the visible light sensor 1100 and the error gain amplifier 1110 are both powered by a substantially DC supply voltage (e.g., +5 VDC). The visible light sensor 1100 monitors the lamp light and outputs a feedback current that is proportional to the level of the lamp light.

In one embodiment, the feedback current is provided to a preliminary low pass filter comprising a first capacitor 1102 coupled between the output of the visible light sensor 1100 and ground and a resistor divider 1104, 1106 coupled between the supply voltage and ground. The filtered (or converted) feedback current is provided to an inverting input of an integrating amplifier. For example, the output of the visible light sensor 1100 is coupled to an inverting input of the error gain amplifier 1110 via a series integrating resistor 1108. An integrating capacitor 1112 is coupled between the inverting input of the error gain amplifier 1110 and an output of the error gain amplifier 1110.

In one embodiment, a desired intensity (or dimming) level is indicated by presenting a reference level (DIM INPUT) at a non-inverting input of the integrating amplifier. The reference level can be variable or defined by a user. The reference level can be scaled by a series resistor 1116 coupled between the reference level and the non-inverting input of the error amplifier 1110 and a resistor divider 1114, 1118 coupled to the non-inverting input of the error amplifier 1110. The output of the error amplifier 1110 can be further filtered by a series resistor 1120 with a resistor 1122 and capacitor 1124 coupled in parallel at the output of the automatic brightness control circuit to generate the control signal for adjusting the operating lamp current.

Figure 12:
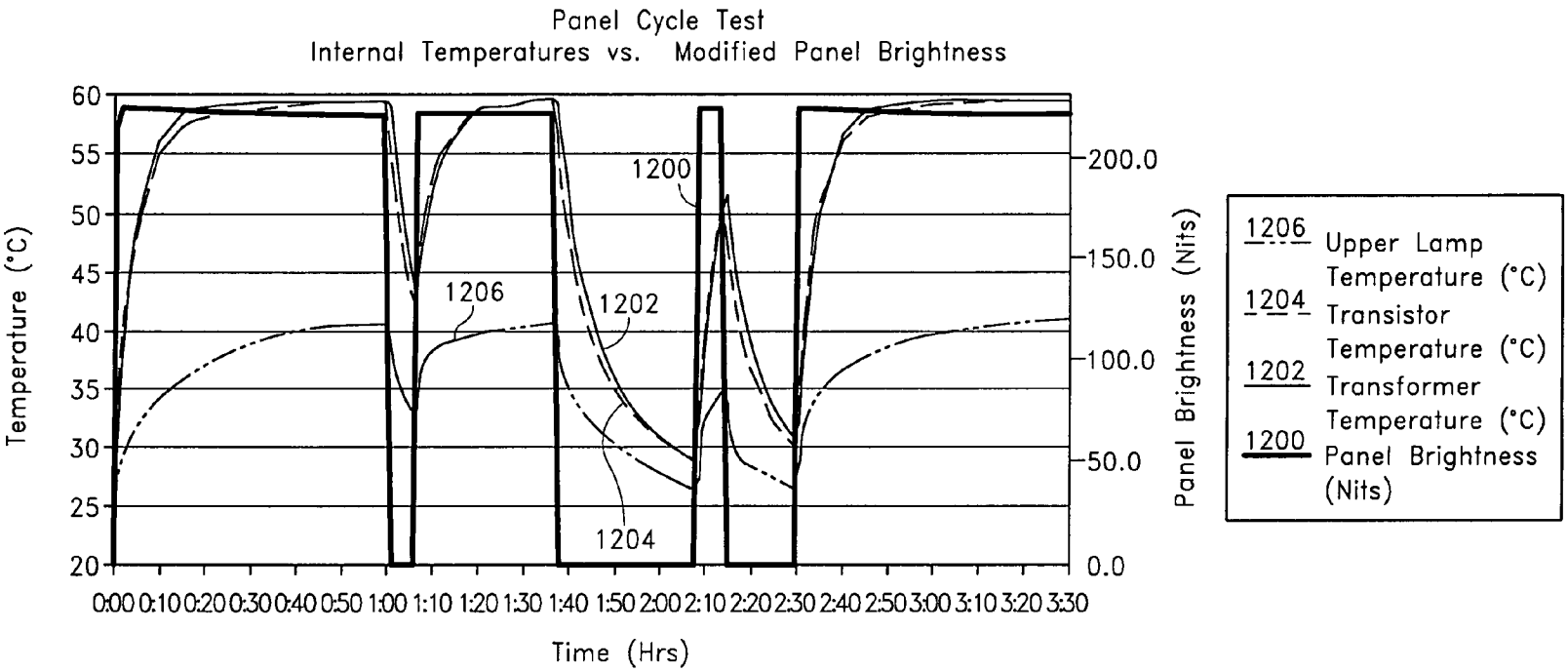
FIG. 12 illustrates waveforms for panel brightness and temperatures of select inverter components with respect to time using the automatic brightness control circuit as a display panel cycles on and off.

FIG. 12 is a graph illustrating panel brightness and temperatures of select inverter components with respect to time using the automatic brightness control circuit to monitor lamp intensity as a display panel cycles on and off. A graph 1200 shows the panel brightness modified by the automatic brightness control circuit. A graph 1202 shows the associated temperature profile for a transformer and a graph 1204 shows the associated temperature profile for a transistor in the inverter. Finally, a graph 1206 shows the upper lamp temperature profile. In comparison with similar graphs shown in FIG. 5, the corresponding graphs in FIG. 12 show faster transitions in reaching the desired panel brightness after turn on or exiting sleep mode by using the automatic brightness control circuit.

Figure 13:
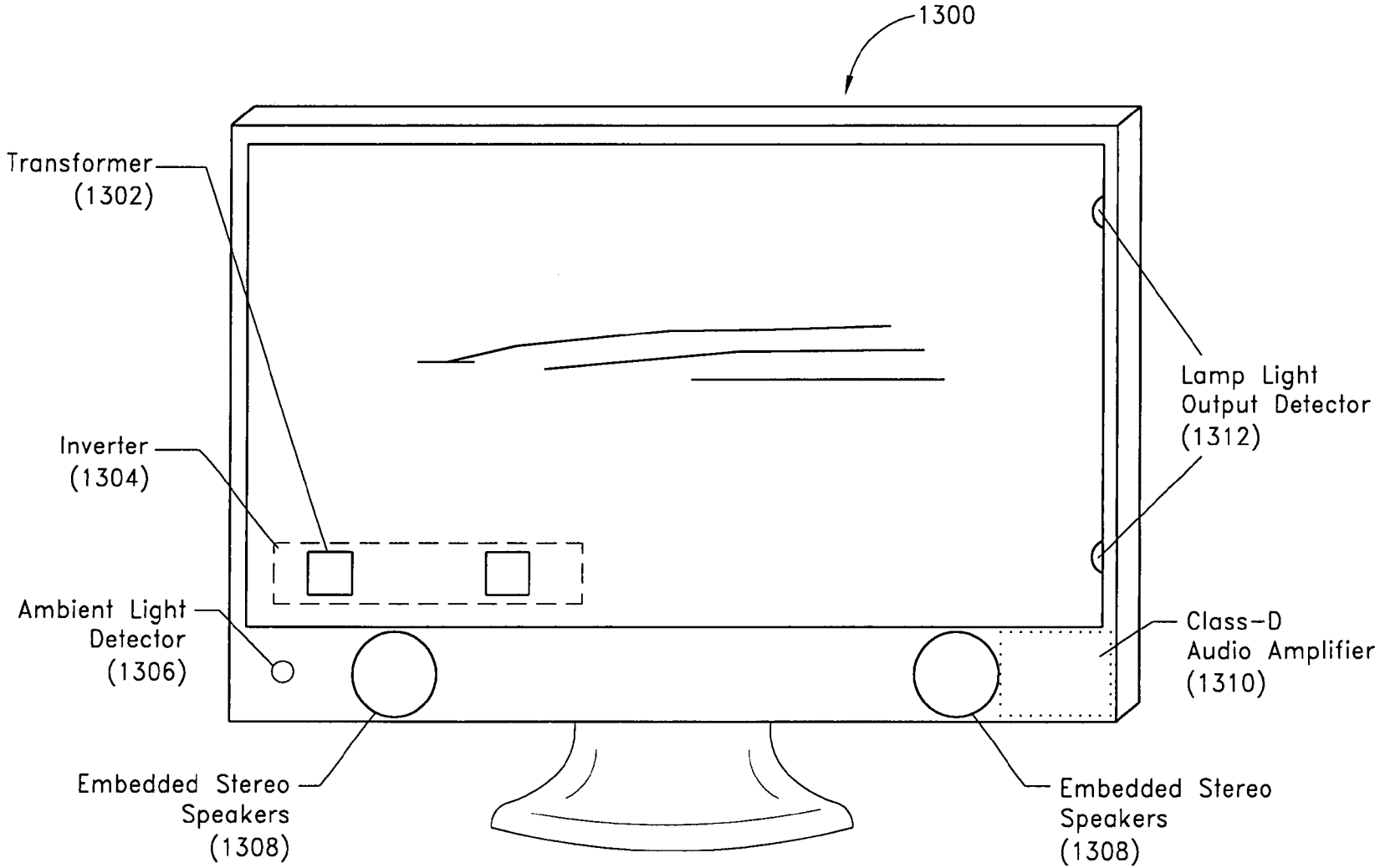
FIG. 13 illustrates one embodiment of a LCD monitor with a light detector which is interfaced to a lamp inverter for closed loop illumination control.

FIG. 13 illustrates one embodiment of a LCD monitor 1300 with light detectors 1306, 1312 which are interfaced to a lamp inverter 1304 for closed loop illumination control. One or more visible light detectors 1312 may be located proximate to one or more backlight lamps to monitor lamp intensity. The visible light detectors 1312 enhance warm-up and maintain constant backlight intensity over lamp life and operating temperature. An additional visible light detector 1306 may be located in a corner of the LCD monitor 1300 for monitoring ambient light. The additional visible light detector 1306 facilitates automatic adjustment of backlight intensity based on environment lighting. The lamp inverter 1304 with one or more low profile transformers 1302 can be located in a corner of the LCD monitor 1300. In one embodiment, the LCD monitor 1300 further includes embedded stereo speakers 1308 and a Class-D audio amplifier 1310.

Although described above in connection with CCFLs, it should be understood that a similar apparatus and method can be used to drive light emitting diodes, hot cathode fluorescent lamps, Zenon lamps, metal halide lamps, neon lamps, and the like While certain embodiments of the invention have been described, these embodiments have been presented by way of example only, and are not intended to limit the scope of the inventions. Indeed, novel methods and systems described herein may be embodied in a variety of other forms; furthermore, various omissions, substitutions and changes in the form of the methods and systems described herein may be made without departing from the spirit of the invention. The accompanying claims and their equivalents are intended to cover such forms or modifications as would fall within the scope and spirit of the inventions.

What is claimed is:

1. An illumination control circuit comprising:

an optical sensor configured to detect visible light produced by a light source;

a thermal sensor configured to indicate temperature of the light source;

a first feedback loop configured to generate a brightness control signal based on comparing an output of the optical sensor to a predefined brightness setting; and a second feedback loop configured to override the first feedback loop when the thermal sensor indicates that the temperature of the light source is above a predefined temperature limit.

2. The illumination control circuit of claim 1, further comprising a control circuit configured to receive the brightness control signal and to adjust current conducted to the light source.

3. The illumination control circuit of claim 2, wherein the control circuit operates the light source at a boosted current level during warm-up.

4. The illumination control circuit of claim 1, wherein the optical sensor is mounted in the back of a liquid crystal display monitor to detect visible light produced by the light source.

5. The illumination control circuit of claim 1, wherein the first feedback loop adjusts current provided to the light source to substantially equalize the output of the optical sensor and the predefined brightness setting, and the second feedback loop reduces the current to the light source when the temperature of the light source is above the predefined temperature limit.

6. The illumination control circuit of claim 1, wherein the predefined brightness setting is variable by a user.

7. The illumination control circuit of claim 1, wherein the first feedback loop comprises:

a gain amplifier coupled to the output of the optical sensor; and a first error amplifier with an inverting input coupled to an output of the gain amplifier and a non-inverting input configured to receive the predefined brightness setting.

8. The illumination control circuit of claim 7, wherein the second feedback loop comprises:

a second error amplifier with an inverting input coupled to an output of the thermal sensor and a non-inverting input configured to receive the predefined temperature limit; and a pair of OR-ing diodes coupled between the respective error amplifiers and a common node for the brightness control signal.

9. The illumination control circuit of claim 1, wherein the light source is a light emitting diode, a cold cathode fluorescent lamp, a hot cathode fluorescent lamp, a Zenon lamp, or a metal halide lamp.

10. A backlight system comprising:

a high voltage circuit configured to generate a substantially AC voltage signal to produce a substantially AC lamp current through a fluorescent lamp for lighting a display panel;

a controller configured to drive the high voltage circuit in response to a brightness control input; and a dual feedback loop configured to generate the brightness control input based on lamp brightness and lamp temperature.

11. The backlight system of claim 10, wherein the controller drives the high voltage circuit to produce a relatively high predetermined lamp current when the lamp temperature is relatively low.

12. The backlight system of claim 10, wherein the lamp illuminates a television display, a handheld device, a computer notebook screen, a computer monitor, or an automotive display.

13. A method to control brightness of a lamp and prolong lamp life, the method comprising the acts of:

detecting visible light produced by the lamp;

comparing the detected visible light level to a desired brightness level;

generating a first control signal to adjust a lamp current based on the comparison of the detected visible light level to the desired brightness level;

detecting operating temperature of the lamp;

comparing the detected operating temperature to a selected limit; and overriding the first control signal to reduce the lamp current when the detected operating temperature is above the selected limit.

14. The method of claim 13, wherein the first control signal increases the lamp current to a substantially constant boost level when the detected visible light level is less than the desired brightness level.

15. The method of claim 13, wherein the first control signal decreases the lamp current to a preset nominal level when the detected visible light level is greater than the desired brightness level.

16. The method of claim 13, wherein the lamp is driven by an inverter and the operating temperature of the lamp is detected indirectly by monitoring a temperature of a component in the inverter.

17. An illumination control circuit comprising:

means for monitoring brightness of a light source;

means for monitoring temperature of the light source;

means for adjusting power to the light source to achieve a predefined brightness level using an optical feedback loop; and means for transferring control to a thermal feedback loop to reduce power to the light source if the temperature of the light source is greater than a predefined threshold.

18. The illumination control circuit of claim 17, wherein the light source comprises at least one cold cathode fluorescent lamp used to backlight a liquid crystal display.

19. The illumination control circuit of claim 17, wherein a boosted current is provided to the light source when the optical feedback loop indicates that the light source has not achieved the predefined brightness level.

20. The illumination control circuit of claim 17, wherein a nominal current is provided to the light source when the optical feedback loop indicates that the light source has reached the predefined brightness level.

* * * * *